United States Patent [19]

Feuillade

[11] 4,249,873

[45] Feb. 10, 1981

[54] MANUFACTURE OF PRESTRESSED PRODUCTS

[75] Inventor: Jean Louis J. Feuillade, Cagnes, France

[73] Assignee: B. M. Costamagna et Cie, Cagnes, France

[21] Appl. No.: 20,351

[22] Filed: Mar. 14, 1979

Related U.S. Application Data

[63] Continuation of Ser. No. 830,058, Sep. 2, 1977, abandoned.

[30] Foreign Application Priority Data

Mar. 28, 1977 [FR] France ..... 77 09136

[51] Int. Cl.[3] ..... B28B 23/04

[52] U.S. Cl. ..... 425/111; 264/71; 264/228; 264/297; 425/144; 425/211; 425/289; 425/432

[58] Field of Search ..... 425/88, 111, 144, 174.4, 425/211, 432; 264/228, 71, 297

[56] References Cited

U.S. PATENT DOCUMENTS

| | | | |
|---|---|---|---|
| 2,394,228 | 2/1946 | Barber | 425/111 |
| 2,556,928 | 6/1951 | Ludlow | 249/97 |
| 3,608,163 | 9/1971 | Harford | 425/111 |
| 3,659,077 | 4/1972 | Olson | 249/78 |
| 3,666,385 | 5/1972 | Baker | 425/111 |
| 3,827,132 | 8/1974 | Bratchell | 425/111 |
| 3,899,281 | 8/1975 | Jakobs | 425/432 |
| 4,051,216 | 9/1977 | Bratchell | 425/111 |
| 4,061,454 | 12/1977 | Borcoman | 425/111 |
| 4,105,382 | 8/1978 | Auer | 425/111 |

FOREIGN PATENT DOCUMENTS 2254946 7/1975 France .

*Primary Examiner*—Thomas P. Pavelko
*Attorney, Agent, or Firm*—Darby & Darby

[57] ABSTRACT

Apparatus for forming prestressed concrete beams comprising groups of molds, each group forming a module, with the modules arranged consecutively and tracks are placed alongside the modules. Plates seal off the ends of each mold and the beams are lifted off the molds by the plates after the prestressing wires have been cut.

32 Claims, 12 Drawing Figures

MANUFACTURE OF PRESTRESSED PRODUCTS

This is a continuation of application Ser. No. 830,058, filed Sept. 2, 1977 now abandoned.

In French patent application No. 73/44,993 filed Dec. 17, 1973, in the name of the applicant, there is described a method and a device for the manufacture of elongated products of prestressed concrete, in which modules forming batteries of parallel molds are aligned on a prestress bench and combined with a mobile beam bearing end plates, one set with vertical slots and the other with horizontal slots, for the correct positioning of the prestressing bars.

The prior method and device when used, prove to be expensive to embody and somewhat awkward to use. The present invention envisages improvements which tend to simplify the method and device, making it easier to operate and more productive.

The present invention is directed to the manufacture of elongated prestressed products in which the molds are disposed in independent batteries or modules which have travelling tracks on each side. Each module is mounted on a fixed support by means of a damper unit. Sliding shoes mounted on any suitable support, such as an intermediate chassis borne by the dampers, and have thereon devices suitable for preventing lateral sliding of the modules.

The invention also includes the following features:

(1) The modules are separated and independent, and the lateral tracks are disposed in such a way that two consecutive tracks have a space between them, on the order of 5 mm to 2 cm, for the relative sliding of the modules during the process of manufacturing the products.

(2) Means such as jacks and stops are provided for the return of the modules to their original position after unmolding the products.

(3) The dampers have a greater extension in the lateral direction of the bench than in the direction of its length.

(4) The wires are positioned by means of end plates pierced with holes according to an appropriate arrangement, and applied individually at the end of each mold, of which they constitute the terminal walls.

(5) The bottoms of the end plates rest on studs borne by the mold, and are held in place by pins passing laterally through vertical sleeves borne by the outer wall of the end plates, as well as ears borne by the ends of the mold. Due to this arrangement, a two-fold function is obtained. First, the prestress cables are correctly positioned, and second the end plates are drawn up tightly against the ends of the mold and insure a seal against losses of grout.

(6) The openings in the two successive end plates are offset in opposite directions relative to the theoretical axis of the wires in such a way that the installation of the end plates provides a correct centering of the wires in spite of any differences between the diameter of the wires and the diameter of the openings.

(7) The placement of the end plates is carried out by means of a carriage moving on tracks lateral to the modules, and carrying longitudinal supports cooperating with shoulders provided at the top of the end plates, in such a way as to permit the movement of the carriage loaded with end plates above the modules, with retractable retaining means for the end plates provided at the rear of the carriage.

(8) The end plates are disposed side by side on the carriage with the prestress wires passing through the said end plates and extending over the modules, and the carriage is gradually moved from one end of the bench to the other, the retractable means being retracted by each passage between two modules to allow a series of pairs of end plates to pass, and being returned to their first position thereafter.

(9) The retractable means can be formed by a mobile bar, crosswise to the carriage, carrying at its ends, arms which slide in vertical sleeves borne by the carriage.

(10) The retractable means are formed by fingers mounted on a rod crosswise to the carriage, which can rotate around its axis.

(11) The heating pattern of the modules is controlled by means of thermostatic sensor means in a metal piece (holder) placed in the concrete, and these sensors control the operation of the heating means which are separate for each mold.

(12) The heating means are heating panels disposed under each module and formed by gas fed radiant emitters, the feed and the ignition of the gas being controlled by the thermostatic sensors according to a predetermined program.

(13) The thermostatic control is not continuous, but is done on a sampling basis at constant frequency (every minute, for example) and the temperature spreads are minimized, at all points on the bench, whatever the outside situation, by control of the heating means.

(14) To minimize heat losses and make the temperatures in the products more uniform, an isothermic (insulating) tarpaulin is placed on the molds, with the edges of the tarpaulin being at a height insuring insulation and a supply of air to the heating means.

(15) Between vertical sleeves, the end plates have lifting cleats which cooperate with an unmolding device on a carriage moving on the tracks of the modules, this carriage bearing a liftable frame which itself carries, at each end, a mobile rake for each end plate, a rake having two teeth which are inserted into the sleeves, and a third tooth that seizes, by means of a suitable convexity, the cleats of the end plates which were previously unpinned.

The products are thus lifted by raising them by means of the end plates (after the bench has been released and the wires severed.

(16) The severing of the prestress wires takes place before unmolding by a severing means mounted on a carriage moving on the module tracks and fixed in position by a pin cooperating with a hole made in the webs of the rails.

The invention is illustrated by the accompanying drawings in which.

Figure 1:
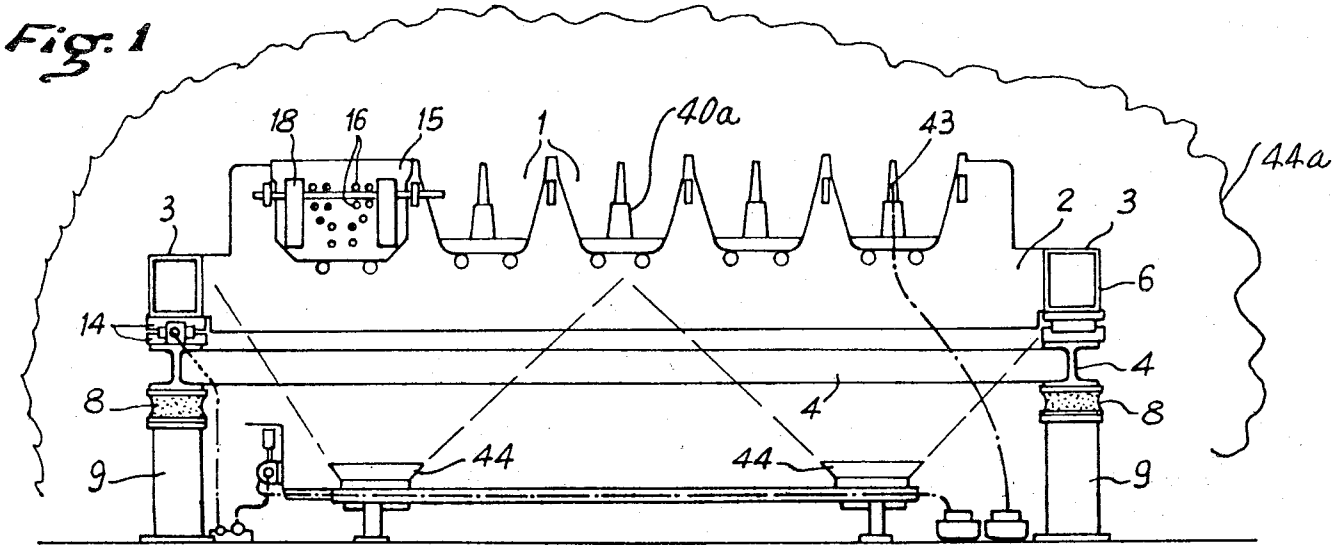
FIGS. 1, 2 and 3 represent, schematically, in end, side and top views in partial section, a module according to the invention for the manufacture of railway ties.
Figure 2:
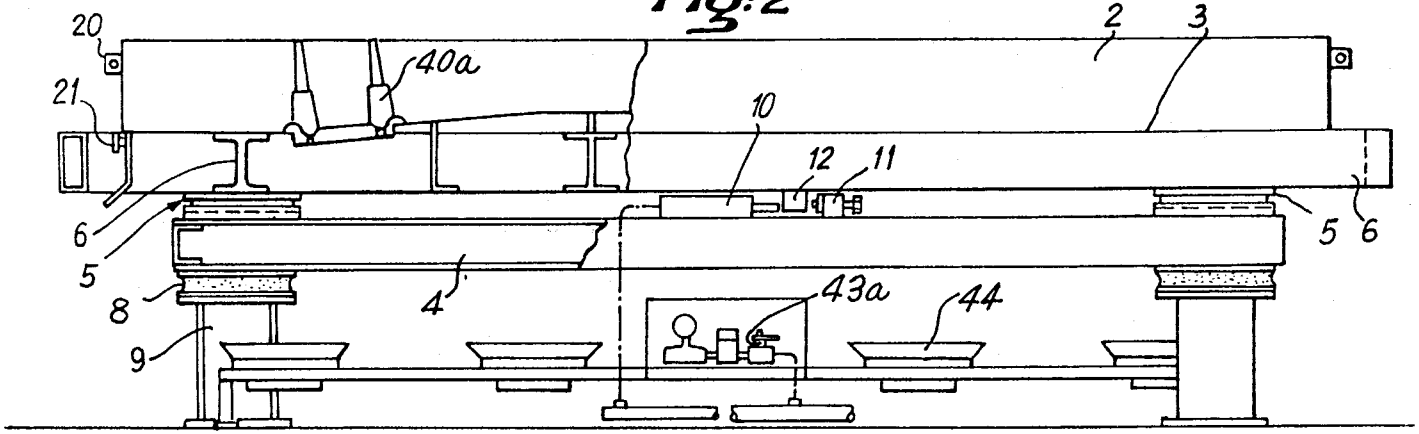
Figure 3:
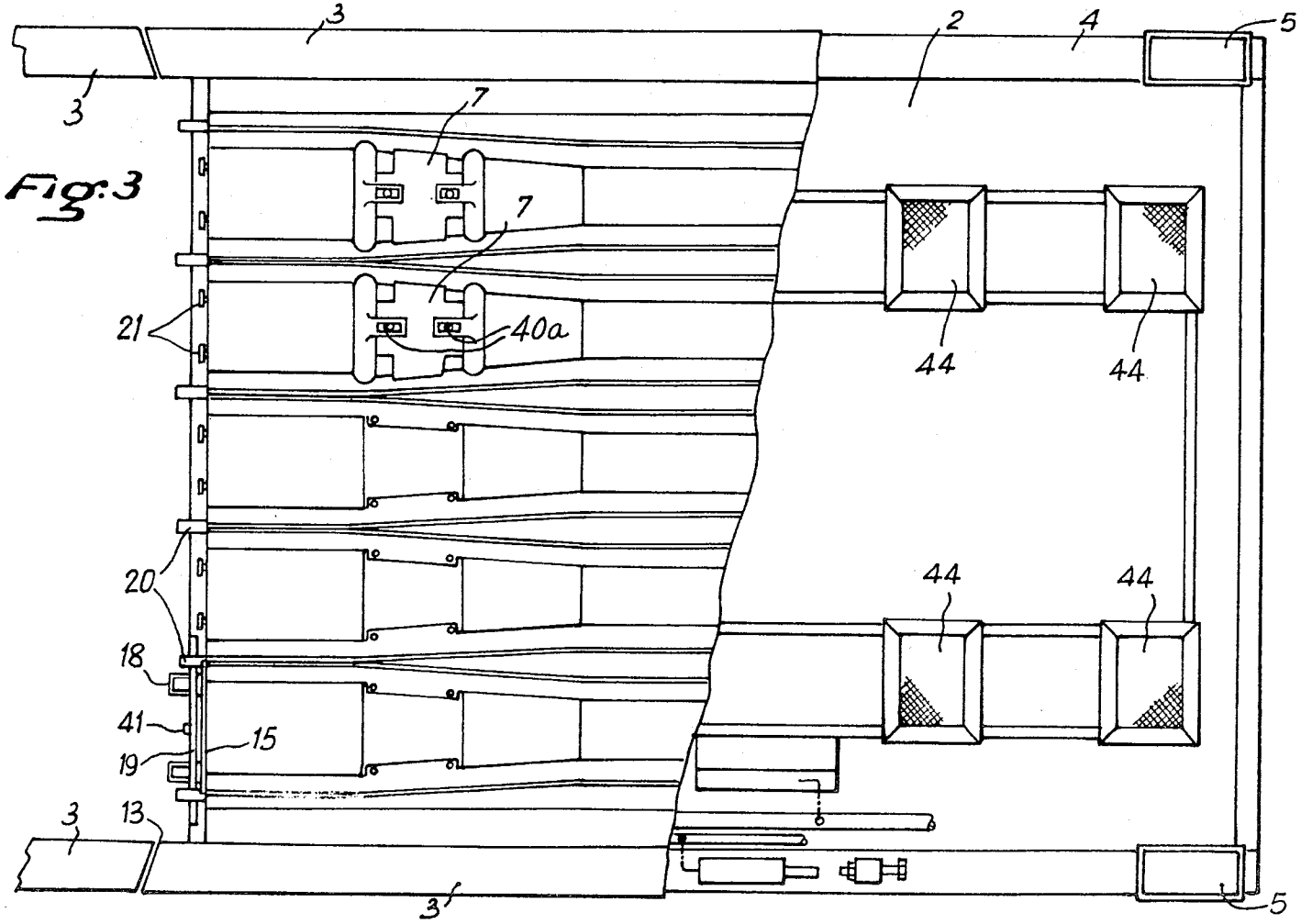

Referring to FIGS. 1 to 3, we see that a plurality of molds 1 are disposed in batteries or forming modules 2, with travelling tracks 3 on each side. A prefabrication bench for prestressed members can include several dozen such forming modules placed end to end. In the example shown, each module has five molds in which the prestressed members, here rail ties 7, are molded upside down. According to the invention, the modules 2 are separate and independent, and the lateral tracks 3 are disposed in such a way that when the modules are put in place, an interval 13 (see FIG. 3), for example on the order of 0.5 cm to 2 cm remains between the said tracks.

Thus the tracks 3 are practically continuous, while the independence of the modules 2 allows their relative independent movements, in particular at the time of the release of the prestress cables, as well as their vibratory isolation in the concreting operation, or the removal of a module without any particular trouble.

The arrangement of the invention in which the modules 2 have side rails 3 makes it possible to reduce or substantially eliminate the position stresses relative to the modules with respect to the various machines used in the various phases of the work (concreting machine, severing machine, unmolding machine, etc.).

In the example represented, each module is composed of assembled forms mounted on a chassis 4 by means of sliding shoes 5. The chassis 4 is itself mounted on dampers 8 preventing the vibration from passing into supports 9 supporting the whole structure which are used to bring the forms to a desired working station level.

The fixed chassis 4 carries one or more jacks 10 and an adjustable stop 11 insuring the repositioning of the module at its initial point after it is displaced by removal of the tension of the prestress wires. Jack 10 acts on a spur 12 of module 2. During the release of the wires and the unmolding, the jacks 10 are released so that the modules 2 can move relative to one another. Shoes 5 then allow the sliding of the modules 2 within limits provided by the spaces 13 left open between the tracks 3 of the various modules.

When the free part of wires between the modules and the part in the concrete has undergone a stretch, the stretch is restored fully for the free parts and partially for the others when the wires are released.

This phenomenon is translated by the relative movement of each module and the displacement of each of them as a function of its position on the bench relative to the fixed point of anchorage of the wires (or fixed "trimmer joist").

Chassis 4, although preferred, is not absolutely necessary. The shoes 5 can be placed directly on the upper metal part of dampers 8.

In any event, it is advantageous to make proper arrangements to avoid the lateral sliding of the modules. With this in mind, the proper conformation of the shoes and the pieces on which they slide, can suffice. As shown a slider and groove configuration is used. Two longitudinal guide pieces 14 can also be adopted as represented on the left in FIG. 1. This longitudinal guidance at the level of the shoes makes it possible to use only one jack 10 per module.

The function of the dampers 8 is to isolate the fixed supports from vibration in the course of the concreting operation. This vibration assumes a crosswise horizontal component, and a vertical component. Only the latter remains during the concreting operation, by the combination of two vibrators (not shown) mounted in parallel. Nevertheless, during the starting or the stopping of the vibration, the crosswise component appears and introduces non-negligible lateral forces. To remedy this, dampers 8 of low transverse stiffness are used. However, the longitudinal stiffness must be sufficient to absorb the forces generated by the sliding of the molds or by the movements of the machines travelling over the latter, particularly those of the unmolding machine. This is why dampers 8 are made longer than they are wide. The compression of the dampers as the machines pass must be limited as much as possible. Otherwise the result is a difference in level from one mold to the other, which is harmful to the movement of the machines. The dimensioning of the dampers is determined by taking these things into account.

Figure 9:
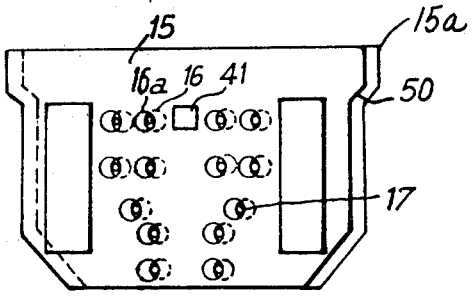
FIG. 9 illustrates the system of recentering of the prestress wires by the successive end plates.

The prestress wires are positioned by passing them through holes 16 made in metal end plates 15 (FIG. 9) which serve as end walls for the molds 1. Holes 16 have a diameter larger than that of the prestress wires. The arrangement of the openings 16 on two consecutive plates is slightly offset relative to the theoretical axis of passage of the wire. As a result, the successive end plates insure a satisfactory recentering of the wire both laterally and in height, as represented in FIG. 9, in which, two successive superposed plates 15 and 15*a* for a mold 1 are shown with their openings 16 and 16*a* and the prestress wires 17.

The positioning of the end plates is accomplished by means of exterior sleeves 18 (FIGS. 1 and 3) carried by the plates. Sleeves 18 have a U-shaped or square section. The sleeves are formed with holes in which are threaded pins 19 with a diameter slightly smaller than the openings in the U sections of sleeves 18. Moreover, each mold 2 has metal ears 20 pierced to the same diameter, in which the pins are threaded.

Studs 21 facilitate the positioning of the end plates 15 on the molds and hold them flush against the molds during the pinning operation. Each end plate 15 of a mold is thus held tightly against the ends of the form by pinning to insure against leakage of grout from the said form.

When special pieces are made, such as railroad ties, represented in the attached drawing, special fittings 40*a* (FIG. 1) are provided, which are preferably pieces of aluminum alloy cast in a metal shell. These fittings fulfill several functions. First they permit molding of the support face of the rails. Secondly, they shape the seat for fastening devices such as cam-bolts which are to be embedded in the ties. They also maintain in position polyurethane or polystyrene pads in the case of cam-bolts.

The assembly of the said fittings makes it possible to insure these functions, as well as the spacing tolerance of the rails. The setting and positioning of these fittings is insured at the level of the coffering module.

A cavity is provided in at least one of the fittings 40*a* in each module and the cavity is equipped with a probe, sensor, or 43 (thermocouple). This assembly surrounded by concrete makes it possible to verify with fair precision the mean temperature in the heart of the concrete, owing to the quality of heat conductivity of the aluminum alloy and the position of the sensor in the mold.

In the absence of a piece of this kind, the thermal sensors will be disposed in the concrete by any appropriate means. As a matter of fact, the setting of the concrete is accelerated by means according to a precise curve of temperature.

To heat the modules, heating panels (FIG. 3) are disposed under each module and are formed by gas fed infra-red radiant emitters 44. The power and the distribution of the heat takes into account the curve of temperature rise in the heart of the concrete. The heating output of each panel is adjustable by means of an electrically controlled feed valve 43*a*, which makes it possible to adjust the heat output according to the curve and even to the season. The heating curve of the concrete of each module, is controlled by and connected to a central regulating system (not shown) where the temperature rise curve is programmed.

The thermostatic sensor 43 (thermocouple) fixed in the cavity of one of the aluminum fittings 40*a* is connected to a central regulating system to indicate the mean temperature in the heart of the concrete. Comparison of the measured temperature with that indicated by the program either produces or does not produce a signal to feed the electrically operated control valve 43*a* and the igniters situated on each heating panel 44 to heat or stop the heat of the module in question. The central regulating system checks each module in sequence thereby insuring the control of the temperature of each module every few minutes, approximately, and therefore makes it possible to limit the temperature spreads at all points on the production bench, whatever the exterior situation.

All safety precautions are assured at the level of the regulating cabinet, as in the gas feed circuit.

In order to minimize losses of heat and make the temperature of the products more uniform, an insulating tarpaulin 44*a* is spread over the molds, covering the edges of the mold to a height satisfactory for insulation while still permitting a supply of fresh air to the heating panels.

Figure 7:
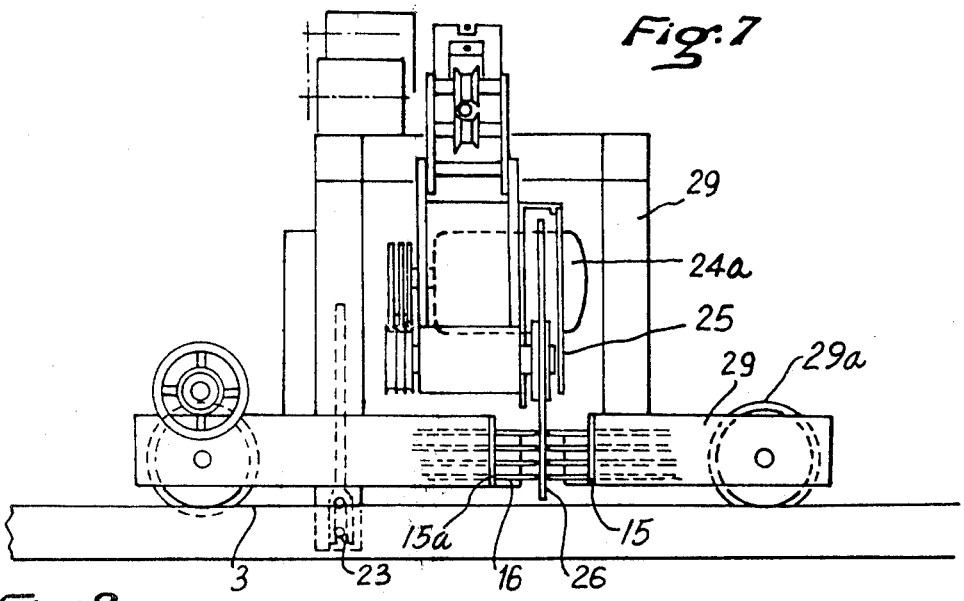
FIGS. 7 and 8 illustrate, in side and end views, a severing carriage.
Figure 8:
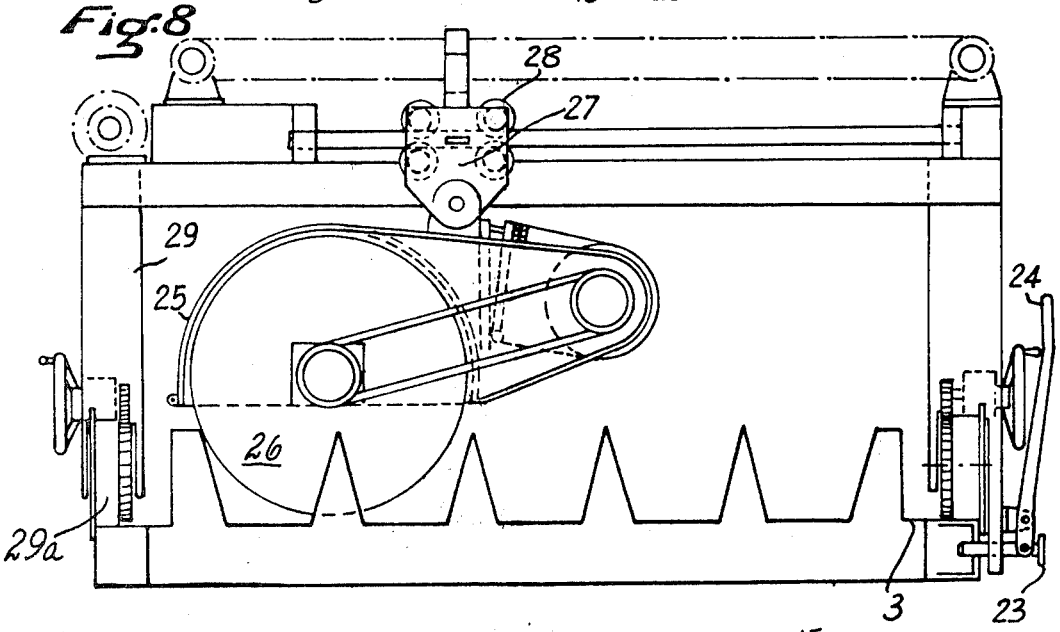

When the desired maturity of the concrete is obtained, as observed by the resistance of the concrete test cylinders, the tension of the wires is released. Before unmolding each module, the wires 16 at each end of the ties must be cut away. To do this, a carriage equipped with a mobile cutting (severing) assembly is positioned in turn over each module to perform the so-called severing operation. This carriage is shown in FIGS. 7 and 8. In FIG. 7 it is shown located between two adjacent modules.

The positioning of the severing machine between modules is obtained by the introduction, in a hole made in the webs of the rails, of a retractable pin 23, actuated by a pivoted lever 24 mounted on the said machine, so that the cut will be made in the axis of the space between adjacent modules.

The severing machine is composed of:

1. A so-called severing head assembly, itself comprising a drive motor 24*a*, transmission and protective housing assemblies 25, and suitable mountings for insuring the function of an oscillating suspension of a severing device 26.

2. A support assembly 27 is mounted on guided rollers 28 for supporting the severing head and for moving it across the module. This is done by the bias of a reciprocating assembly formed by a chain having a fixed point. This chain is actuated by a motor-reducer.

3. A frame 29 mounted on wheels 29 a moves the sectioning machine from one module to the next. On frame 29 are mounted the systems for feeding and positioning the severing head and the advancing mechanism of the machine.

Figure 4:
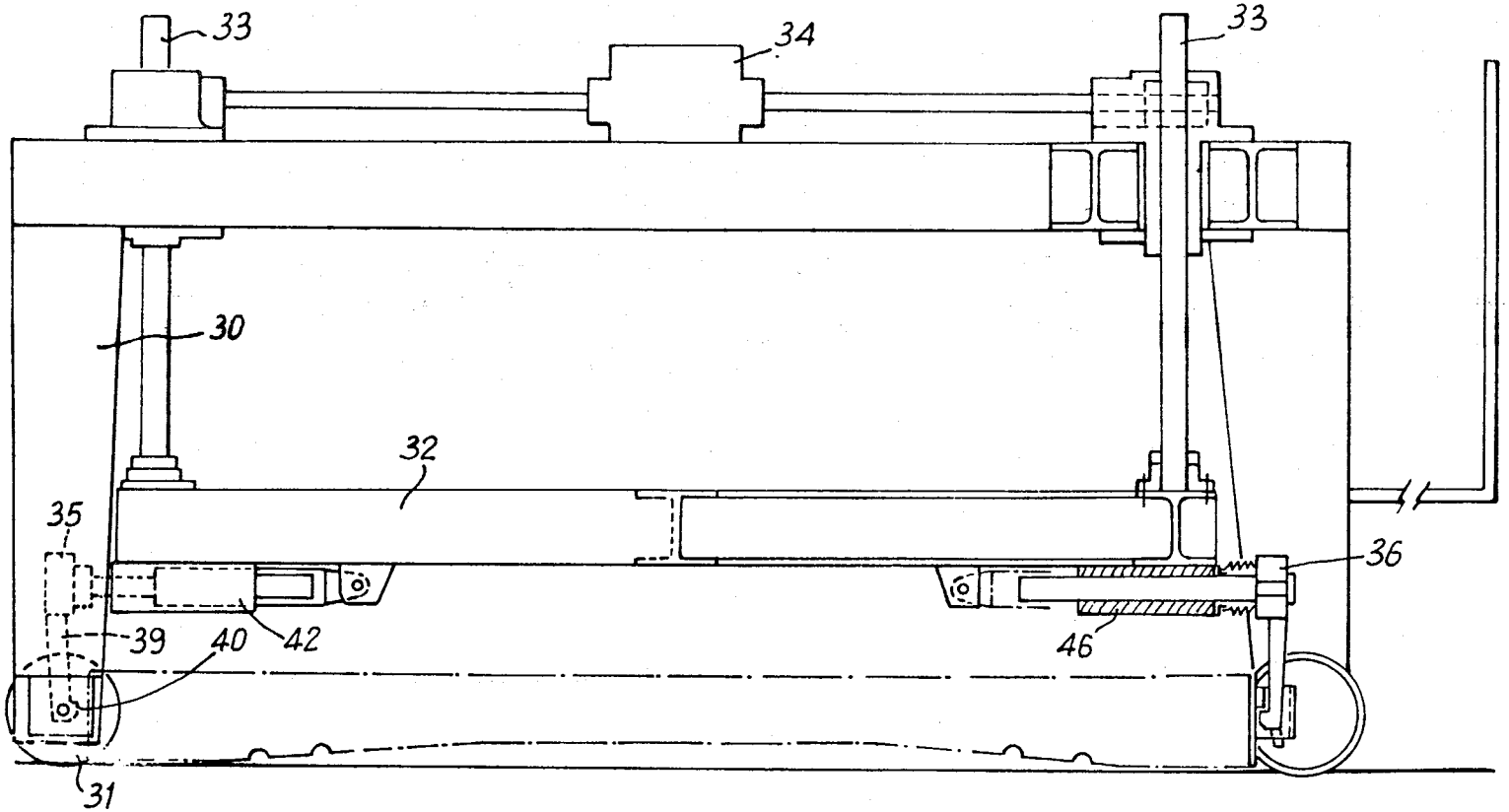
FIGS. 4 and 5 represent, schematically, a carriage for lifting and unmolding the products.
Figure 5:
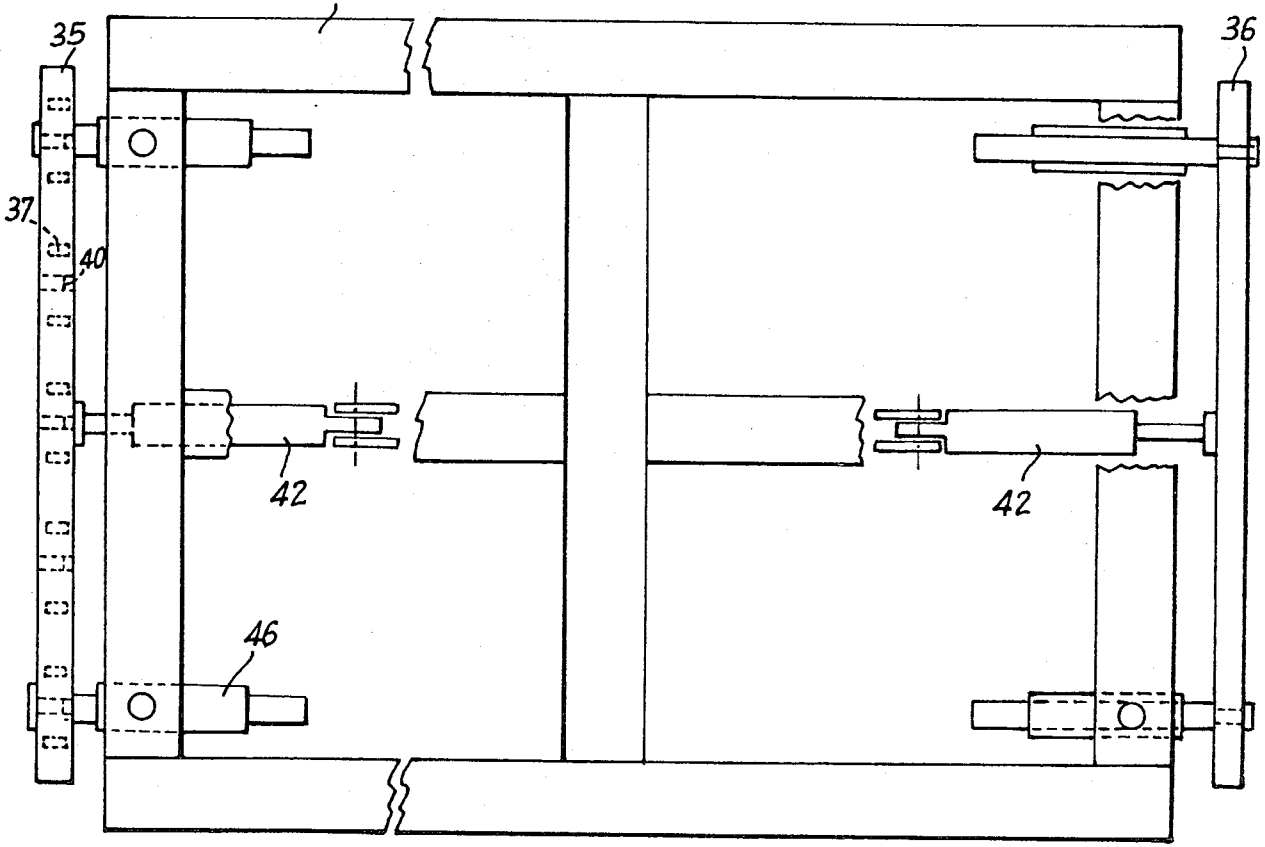
Figure 6:
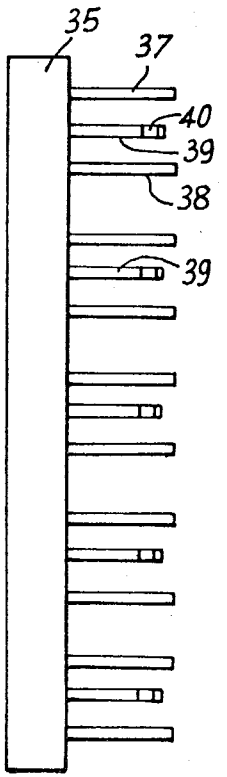
FIG. 6 is an end view of a rake on the carriage.

After the wires 16 are cut by the severing machine the pieces are unmolded with the machine shown in FIGS. 4 to 6. This machine is composed of a frame, or gantry 30 mounted on wheels 31 which run on the tracks 3 of modules 2. This structure 30 has a frame 32 which can be lifted by any suitable system, such as synchronized jacks 33, actuated by a suitable system 34. Frame 32 carries rakes 35 and 36 (FIG. 5) provided with two teeth 37, 38 for each end plate 15 to be inserted into sleeves 18 of the end plates 15, and a third tooth 39 which has a terminal hook 40 for cooperating with a corresponding cleat 41 (FIG. 3) of an end plate. Rakes 35 and 36 are moved by jacks 42 carried by frame 32 and guided by columns 46.

The products, the ties in this case, are unmolded and lifted by seizing them by the terminal combs 35, 36 grasping the plates, the pins 19 having been removed beforehand. That is, jacks 42 are actuated to move rakes 35, 36 inwardly toward the plates. Jacks 33 raise the gantry. Teeth 37, 38 engage sleeves 18 on the end plates and tooth 40 engage cleat 41. The tie is lifted upwardly.

Figure 10:
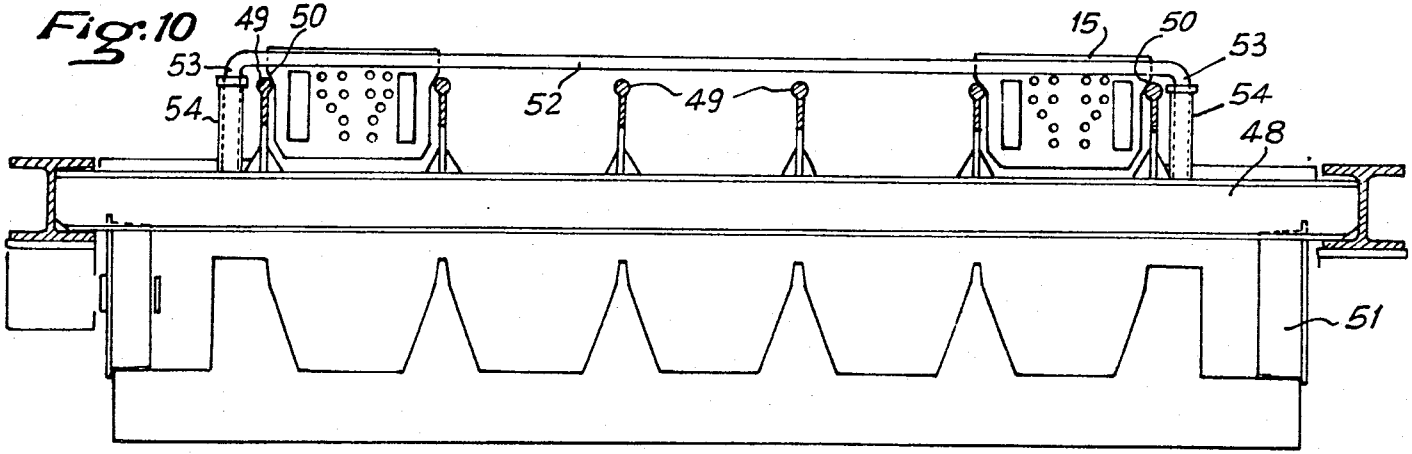
FIGS. 10, 11 and 12 illustrate the system of placement of the end plates.

According to the invention, the combs 15 are preferably distributed on the bench (see FIGS. 10 to 12) by causing them to slide along the prestress wires 16 by means of a carriage 48 moving over the modules, and depositing them in series at the ends of the said modules.

For this purpose, carriage 48 has longitudinal supports 49 cooperating with shoulders 50 borne by the end plates (or their equivalent). The frame of carriage 48 and the supports 49 are situated at a sufficient height so that the assembly loaded with end plates can move on the lateral wheels 51 above the modules 2. Furthermore, carriage 48 has retractable stops 52 which normally prevent the end plates 15 from sliding off the carriage, but can be retracted as desired to allow them to pass.

The operation is to place the carriage 48 at the end of the bench, and load it with end plates 15 by threading through the latter the prestress wires 16, themselves spread out on the modules. With the stop means 52 in place, the carriage is advanced along the bench. In this movement, the end plates 15 press against the stop 52 under the influence of the friction of the prestress wires.

When the rear end of carriage 48 lies above a zone separating two successive modules, stop 52 is pulled out and two series of end plates in opposite position are allowed to slide over the end 49*a* of supports 49, and to fall between the modules. Stop 52 is then returned to place and the advance of the carriage is continued. The end plates thus removed from the carriages are then positioned at the ends of the modules for which they are intended.

Figure 11:
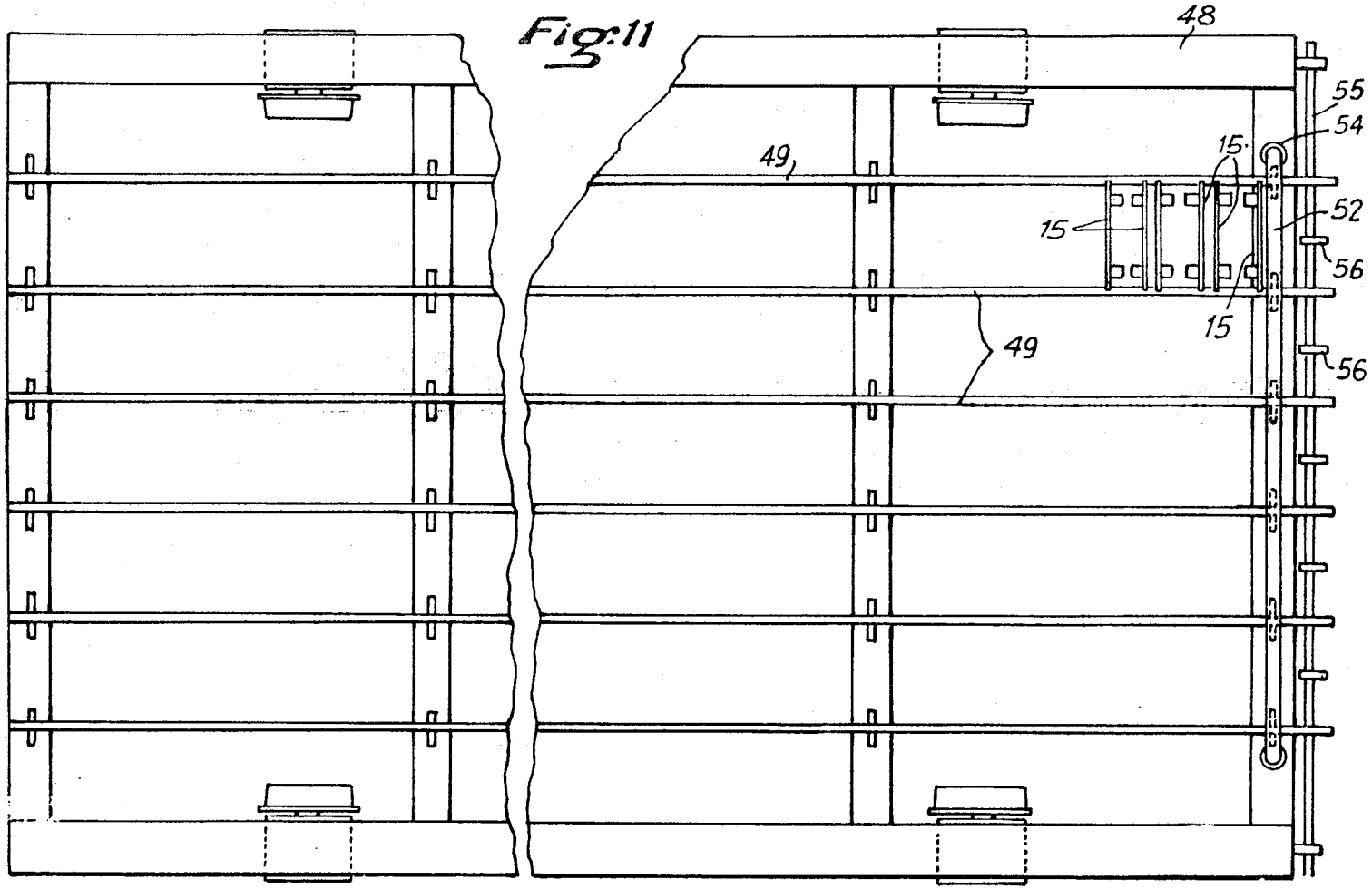

In the example in FIG. 11, stop 52 is formed by a bar 52 crosswise to the carriage, placed at one of its ends and mounted slidably upward on carriage 48 by terminal arms 53 threaded in sleeves 54 carried by the said carriage.

Figure 12:
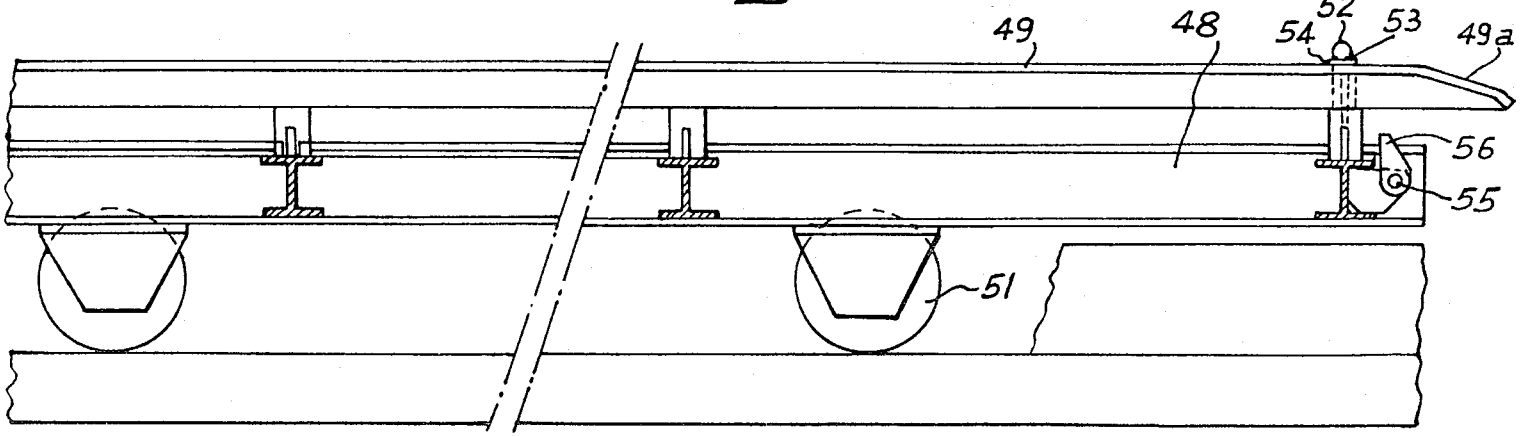

According to an alternative represented in FIG. 12, stop 52 is formed by a bar 55, mounted rotatably at the end of the carriage and bearing fingers 56 which retain the combs (FIG. 12).

All of the dispositions of the invention, with its sliding modules forming travelling tracks, and its system of end plates constituting the ends of the modules permitting the installation of the end plates and furnishing the means for unmolding the products, constitutes a high-yield prestress bench for very sophisticated products such as railroad crossties.

It can, of course, be used and adapted for the manufacture of different products. Likewise, diverse alternatives can be adopted by the man of the art for the embodiment of its various components without thereby departing from the scope of the invention.

What is claimed is:

1. Apparatus for use with a prestressing means in the manufacture of elongated prestressed concrete products comprising:

a plurality of independent modules disposed end to end, each of said modules including a plurality of molds disposed side by side, each said mold for holding a prestressed product, each of said modules including mounting means, support means for the said modules, and damper means attached to said support means between a respective module and its respective mounting means, said mounting means of a respective module mounting said module on the damper means attached to the support means while permitting longitudinal sliding of each of said modules with respect to the support means and preventing lateral sliding of a module with respect to the support means, said damper means providing isolation to vibration between the modules.

2. Apparatus according to claim 1 wherein each said module is separate and independent of the other modules, the space between two adjacent successive modules being in the order of from about 0.5 cm. to about 2 cm.

3. Apparatus as in claim 1 further comprising means for moving each of said modules longitudinally of its respective support means.

4. Apparatus as in claim 3 wherein said moving means comprise jacks.

5. Apparatus as in claim 1 further comprising a plate releasably connected to each end of a said mold to form its end walls, each of said plates having at least one hole therein to accept and hold a prestress wire which passes longitudinally of the respective mold.

6. Apparatus as in claim 5 wherein the holes of a plate at one end of a said mold are offset from the holes in the plate at the other end of said mold from the theoretical axes of the prestress wires so that positioning at the end plates at the end of the mold permits centering of wires irrespective of the difference of wire diameters and diameters of the openings in the plates.

7. Apparatus as in claim 5 further comprising means for lifting a said concrete product from the respective mold, said lifting means engaging the end plates of a respective product.

8. Apparatus as in claim 7 wherein said lifting means comprises a gantry which moves adjacent said modules, said gantry having a vertically liftable frame.

9. Apparatus as in claim 8 further comprising rake means carried by said gantry liftable frame, said end plates of said molds formed with at least one sleeve and said rake means of said gantry formed with a respective finger for gripping a corresponding sleeve.

10. Apparatus as in claim 9 wherein said end plates are also formed with a cleat, said rake means of said gantry also including a finger for engaging said cleat.

11. Apparatus according to claim 5 wherein a said mold includes studs on each end thereof, a said plate resting on said studs.

12. Apparatus as in claim 11 wherein a said mold has a pair of ears at each end thereof, a said plate held to said mold by a transverse pin attached to said ears.

13. Apparatus as in claim 5 further comprising means for placing said plates on the ends of the molds of the modules which are arranged end to end, said plate placing means comprising a carriage which is movable with respect to said modules, said carriage including means for holding said plate during movement along prestress wires laid horizontally above the modules.

14. Apparatus as in claim 13 wherein said plate carriage includes means for moving said carriage with respect to said modules.

15. Apparatus as in claim 13 wherein said plates have shoulders, said plate placing carriage including supports on which the plates are placed resting on their shoulders, said supports being at a height sufficient to permit the displacement of the plate carriage loaded with plates above the modules.

16. Apparatus as in claim 13 further comprising retracting means on said plate carriage to permit the maintaining and placing of said plates between the modules.

17. Apparatus as in claim 16 wherein said retracting means comprise a movable bar located crosswise of the length of the plate carriage, said bar including vertical arms, and vertical sleeves on said carriage in which said arms slide.

18. Apparatus as in claim 16 wherein said retracting means comprises a bar rotatably mounted and located crosswise of the length of the plate carriage, said bar having a plurality of fingers which rotate with the bar.

19. Apparatus as in claim 1 further comprising means for heating the concrete products in the molds of the modules, said heating means including means for sensing the temperature of the concrete products and means responsive to said sensing means for controlling said heating means.

20. Apparatus as in claim 19 wherein said temperature sensing means comprises a housing protruding into a mold within which the concrete is to be poured, and a heat sensitive probe located within said housing.

21. Apparatus as in claim 19 wherein said heating means comprises at least one heating panel disposed adjacent each of said modules.

22. Apparatus as in claim 19 wherein said heating means are gas fed radiant emitters.

23. Apparatus as in claim 19 wherein said temperature sensing means are operated on a periodic basis.

24. Apparatus as in claim 19 further comprising a thermal insulating blanket for overlying said molds.

25. Apparatus as in claim 24 wherein said thermal blanket extends over the ends of the molds and permits air circulation for said heating means.

26. Apparatus as in claim 1 further comprising severing means for cutting prestress wires which are to extend between adjacent modules, carriage means on which said severing means are mounted, said carriage means being movable along the lengths of the modules, and means for fixing the position of said carriage means to position the severing means to cut the wires between two adjacent modules.

27. Apparatus as in claim 26 wherein said severing means move on said modules, said means for fixing the position of said severing means relative to a module comprising pin and pin receptacle receiving means on said module and said severing means.

28. Apparatus as in claim 1 further comprising a separate frame means connected to the damper means for a module, said mounting means of a module mounting the module on said frame means.

29. Apparatus as in claim 1 wherein each of said modules include a track at each side thereof extending at least the length of the module, the mounting means of a respective module being mounted on said tracks.

30. Apparatus as in claim 1 wherein each said module is mounted on a separate chassis, said means for slidably mounting each said module on said rails also being on a chassis separate from said first named chassis.

31. Apparatus as in claim 29 wherein the space between the ends of the tracks of two adjacent modules is in the order of from about 0.5 cm to about 2 cm.

32. Apparatus as in claim 29 further comprising cross pieces between the pair of tracks of each said module.

* * * * *